US009808669B2

(12) United States Patent
Letow

(10) Patent No.: US 9,808,669 B2
(45) Date of Patent: Nov. 7, 2017

(54) DEVICE FOR TRAINING ABDUCTORS AND/OR ADDUCTORS OF THE HIP JOINT

(71) Applicant: Nikolai Letow, Dresden (DE)

(72) Inventor: Nikolai Letow, Dresden (DE)

( * ) Notice: Subject to any disclaimer, the term of this patent is extended or adjusted under 35 U.S.C. 154(b) by 0 days.

(21) Appl. No.: 15/478,280

(22) Filed: Apr. 4, 2017

(65) Prior Publication Data

US 2017/0282009 A1 Oct. 5, 2017

(30) Foreign Application Priority Data

Apr. 5, 2016 (DE) ..... 10 2016 205 596

(51) Int. Cl.
*A63B 23/04* (2006.01)
*A63B 21/00* (2006.01)
*A63B 22/00* (2006.01)

(52) U.S. Cl.
CPC ..... *A63B 23/0488* (2013.01); *A63B 21/4034* (2015.10); *A63B 21/4045* (2015.10); *A63B 22/0023* (2013.01)

(58) Field of Classification Search
CPC ..... A63B 23/0488; A63B 21/4034; A63B 21/4045; A63B 22/0023; A63B 21/4035; A63B 2210/50; A63B 21/068; A63B 21/4029; A63B 21/0428; A63B 23/0205; A63B 23/0211; A63B 2225/09; A63B 21/4047; A63B 23/0222; A63B 21/4031; A63B 22/20; A63B 2208/0242; A63B 21/0004; A63B 22/203; A63B 23/1281; A63B 2071/025
USPC ..... 482/142
See application file for complete search history.

(56) References Cited

U.S. PATENT DOCUMENTS 4,836,536 A * 6/1989 Jones ..... A63B 23/0211 482/134
4,858,919 A * 8/1989 Jones ..... A63B 23/0211 482/137
5,135,459 A * 8/1992 Perry, Jr. ..... A63B 21/00047 482/144
5,163,890 A * 11/1992 Perry, Jr. ..... A63B 21/00047 482/142

(Continued)

FOREIGN PATENT DOCUMENTS

DE 9405749 U1 7/1994
DE 19737441 A1 3/1999

(Continued)

*Primary Examiner* — Andrew S Lo
(74) *Attorney, Agent, or Firm* — Michael Soderman

(57) ABSTRACT

A device for training abductors and/or adductors of the hip joint, having a frame and guided, movable seating. The characterizing feature of the device is that abductors and/or adductors of the hip joint can be trained. To this end, the guiding component of the seating, which is pivotally connected to the frame and can be locked in various positions, has a first rest for at least lateral placement of the knee, at least a lower leg region and/or at least a thigh region of one leg. Furthermore, the guided component of the seating is provided with a seat having a second rest and a third rest for lateral placement of at least the upper region of the pelvis and/or at least a region of the upper body. The second rest and/or the third rest can be adjusted into and locked in its position in order to provide lateral fixing.

12 Claims, 5 Drawing Sheets

(56) References Cited

U.S. PATENT DOCUMENTS 5,295,936 A * 3/1994 Perry, Jr. ..... A63B 21/00047 482/134
5,518,482 A 5/1996 Hsieh
5,722,917 A * 3/1998 Olschansky ..... A63B 22/0005 482/130
6,340,342 B1 1/2002 Lee
6,575,884 B1 * 6/2003 Eazor ..... A63B 23/0211 482/140
7,329,213 B1 * 2/2008 Farley ..... A63B 23/0211 482/140
7,485,078 B1 2/2009 Chen
8,845,560 B1 * 9/2014 Hernandez ..... A61H 1/005 297/338
2004/0067830 A1 * 4/2004 Rovere ..... A63B 23/035 482/140
2004/0157712 A1 * 8/2004 Bodily ..... A61H 1/0266 482/142
2006/0281610 A1 * 12/2006 Perez, Jr. ..... A63B 23/0211 482/130
2006/0293156 A1 * 12/2006 Trees ..... A61H 1/0229 482/148
2007/0037673 A1 * 2/2007 Giannelli ..... A63B 21/068 482/95
2007/0225136 A1 * 9/2007 Roman ..... A63B 21/068 482/142
2007/0259760 A1 * 11/2007 Perez ..... A63B 21/068 482/140
2009/0018000 A1 * 1/2009 Brown ..... A63B 21/068 482/140
2010/0204025 A1 * 8/2010 Vanterpool ..... A63B 21/068 482/133
2011/0009249 A1 * 1/2011 Campanaro ..... A63B 21/068 482/131
2015/0051520 A1 2/2015 Donohue
2015/0151158 A1 * 6/2015 Ellis ..... A63B 23/0205 482/142
2015/0251050 A1 * 9/2015 Letow ..... A63B 23/0211 482/142
2016/0354627 A1 * 12/2016 Cygan ..... A63B 24/0087
2017/0056728 A1 * 3/2017 Todd ..... A63B 26/003

FOREIGN PATENT DOCUMENTS

DE 29911863 U1 12/1999
DE 102011085571 A1 5/2013

* cited by examiner

DEVICE FOR TRAINING ABDUCTORS AND/OR ADDUCTORS OF THE HIP JOINT

CROSS REFERENCE TO RELATED APPLICATIONS

This application claims the priority of DE 102016205596.8 filed on Apr. 5, 2016; this application is incorporated by reference herein in its entirety.

BACKGROUND

The invention relates to devices for training abductors and/or adductors of the hip joint, having a frame and guided, movable seating.

Training devices for the widely differing zones and musculature of the human body are known from a huge variety of publications.

A training device for the trunk musculature is known from German publication DE 94 05 749 U1. In order to train the trunk musculature, the device consists of a construction with a base frame, a holding frame, an air-filled ball and fixing means for the legs and lower body. The air-filled ball supports the weight of the upper body in the supine, prone or lateral position of the individual. The fixing means disposed at the opposite end of the base frame holds the feet, the lower leg or the knee of the training individual firmly, depending on the type of exercise. The knees, thighs or pelvis lie on the support disposed in the middle.

The publication DE 10 2011 085 571 A1 discloses a training device for the trunk musculature wherein the extensor muscles and the abdominal muscles in particular can be trained. For this purpose, a frame is provided with seating which has a seat for relaxed sitting without ground contact, at least one rest, a first fixing means for the pelvis and at least one second fixing means for an arm or a hand. When coupled up with the first fixing means, the seat is displaceable in a guided manner with respect to the rest provided with the second fixing means. Furthermore, the rest is a back rest, a side rest or a rest for the front region of the upper body, so that the pelvis can move while the upper body is stationary.

The publication DE 197 37 441 A1 discloses a weight training device for strengthening the leg musculature. The individual who is exercising sits in the weight training device on a seating surface which is inclined slightly rearwardly and which has a back rest which is also rearwardly inclined. The thighs of both legs lie on two padded supports which are each linked to one of two mutually symmetrically disposed work arms which are pivotally mounted under the seating surface. For adduction, the legs are pressed together and for abduction, they are spread apart. The rotational movement of the work arms which is necessary is transformed into a linear movement with which the training weight suspended in a frame is moved. The construction is very complicated. The training performance is determined by the weights to be moved, and to change the training routine, weights have to be changed, supplemented or removed. Training of the adductors or abductors on only one side is practically impossible.

SUMMARY

The invention relates to devices for training abductors and/or adductors of the hip joint, having a frame and guided, movable seating.

The characterizing feature of the device is that abductors and/or adductors of the hip joint can be trained.

To this end, the guiding component of the seating, which is pivotally connected to the frame and can be locked in various positions, has a first rest for at least lateral placement of the knee, at least a lower leg region and/or at least a thigh region of one leg. Furthermore, the guided component of the seating is provided with a seat having a second rest and a third rest for lateral placement of at least the upper region of the pelvis and/or at least a region of the upper body. The second rest and/or the third rest can be adjusted into and locked in its position or their positions in order to provide lateral fixing.

DETAILED DESCRIPTION

The object of the invention defined in patent claim 1 is to provide a device for training abductors and/or adductors of the hip joint.

This object is achieved by means of the features defined in patent claim 1.

The devices with a frame and guided, movable seating are particularly distinguished in that abductors and/or adductors of the hip joint can be trained.

For this purpose, the guiding component of the seating which is pivotally connected to the frame and which can be locked in various positions is provided with a first rest for at least lateral placement of the knee, at least a lower leg region and/or at least a thigh region of one leg. Furthermore, the guided component of the seating is provided with a seat having a second rest and/or a third rest for lateral placement of at least the upper region of the pelvis and/or at least a region of the upper body. The second rest and/or the third rest can be adjusted into and locked in its position or their positions in order to provide lateral fixing.

As is well known, the abductors of the hip joint act as a brace to move the leg away from the median plane of the body. The adductors of the hip joint muscles act to bring it in and pull the leg back to its starting position. The devices are advantageous in this case because the abductor and/or adductor muscles of the hip joint can be trained. This is carried out by means of the placement of the respective knee on the first rest and by means of pulling in or pushing out the knee in connection with the movement of the guided seating with the pelvis being locked. The second rest and the third rest for locking at least the pelvis and the position of the first rest mean that specifically, only those muscles of the abductors or adductors of the hip joint can be trained. In particular, the pelvis and the upper body remain in a rest position. This removes the mental barriers to use, in particular for untrained or older individuals. Naturally, this does not preclude training for fit individuals. The training device can also be used for rehabilitation.

Advantageous embodiments of the invention are provided in patent claims 2 to 13.

In accordance with the embodiment of patent claim 2, the first rest is a first rest for pushing out the knee, at least the lower leg region and/or at least the thigh region, so that the abductors of the hip joint can be trained. In particular, these are the abductors connected to that knee.

In accordance with the embodiment of patent claim 3, the first rest is a first rest for pulling in the knee, at least the lower leg region and/or at least the thigh region, so that the adductors of the hip joint can be trained. In particular, these are the adductors connected to that knee.

In accordance with the embodiment of patent claim 4, the first rest can be displaced in a manner which is guided and can be locked in various positions with respect to the guiding component of the seating. The training device can thus easily be adjusted to the size of the user.

In accordance with the embodiment of patent claim 5, the first rest has a support which is disposed at an angle for the knee, at least a lower leg region or the knee and at least a lower leg region. In this manner, the user can support the knee or the knee and the lower leg region during training. This results in both enhanced comfort and uninhibited use during training.

In accordance with the embodiment of patent claim 6, a support for at least a lower arm is connected to the second rest and/or the third rest. The user can rest on it, providing for comfort during use.

In accordance with the embodiment of patent claim 7, the height of the second rest and/or its distance from the third rest can be adjusted with respect to the seat and it can be locked in various positions.

In accordance with the embodiment of patent claim 8, the height of the third rest and/or its distance from the second rest can be adjusted with respect to the seat and it can be locked in various positions.

Because of the embodiments of patent claims 7 and 8, the device can easily be adjusted to the size of the user.

In accordance with the embodiment of patent claim 9, the second rest and at least a region of the seat are disposed in a manner such that the thigh can be moved in the extended or flexed hip position in order to train the abductors or the adductors of the hip joint.

In accordance with the embodiment of patent claim 10, the guiding component of the seating is connected to the frame via at least one pivot or is a component of the frame. Furthermore, the guiding component can be locked in various positions by means of a mechanism so that the seating can be tilted with respect to the footprint and can be locked in the respective tilted position. The intensity of the training can be influenced by the angle because the user's weight can also be brought into play.

In accordance with the embodiment of patent claim 11, the guided component formed by the seat with the seat, the second rest and the third rest is constituted by a straight guide formed by two mutually parallel guiding elements and at least two guided elements connected therewith and which are slide guided or roller guided elements. In this manner, a more stable seat with the second rest, the third rest and the footrests is formed in a simple manner.

In accordance with the embodiment of patent claim 12, the guided component of the seating is provided with footrests for the foot of the respective other leg. Advantageously, the device has footrests on both sides of the seat so that the user can train the abductors and adductors on both sides of the hip joint. To change over, the user only has to turn round on the device. The footrests are provided for the respective foot which is not connected to the knee on the first rest. Thus, the footrests ensure that the device is used to train the abductors and adductors on both sides, guaranteeing comfortable training.

An exemplary embodiment of the invention is shown in principle in the accompanying drawings and will be described in more detail below.

DETAILED DESCRIPTION OF THE PREFERRED EMBODIMENTS

Figure 1:
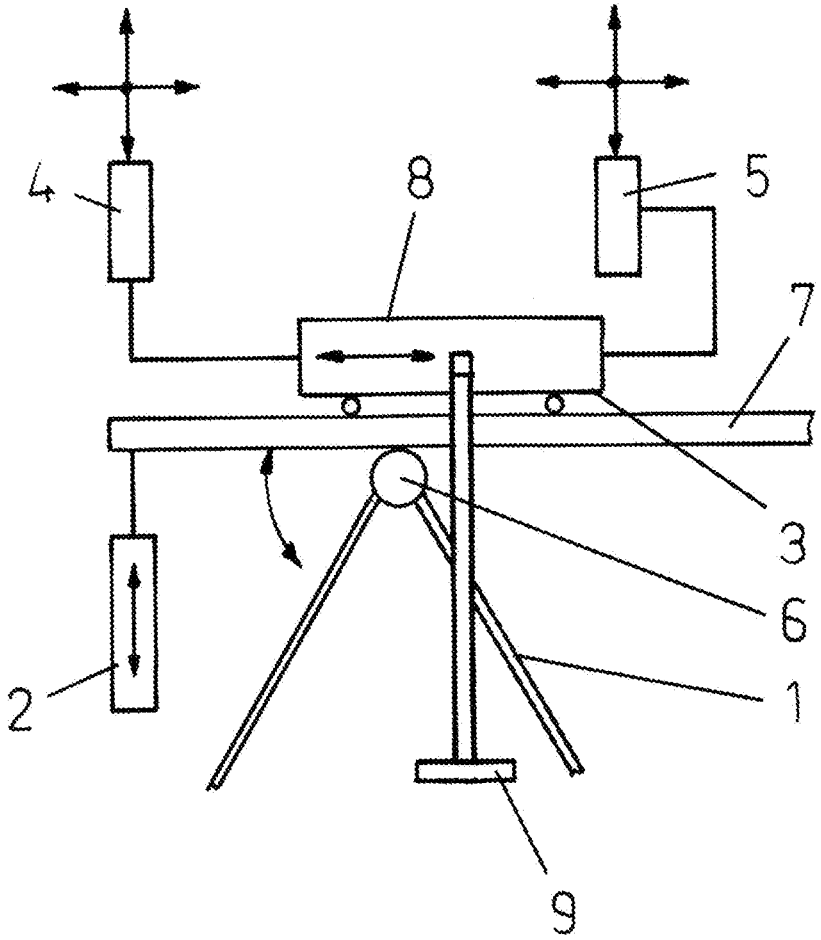
FIG. 1 shows a device for training abductors and/or adductors of the hip joint in side view.

A device for training the abductors and/or adductors of the hip joint essentially consists of a frame 1 with a first rest 2 and movable seating 3 with a second rest 4 and a third rest 5.

Figure 2:
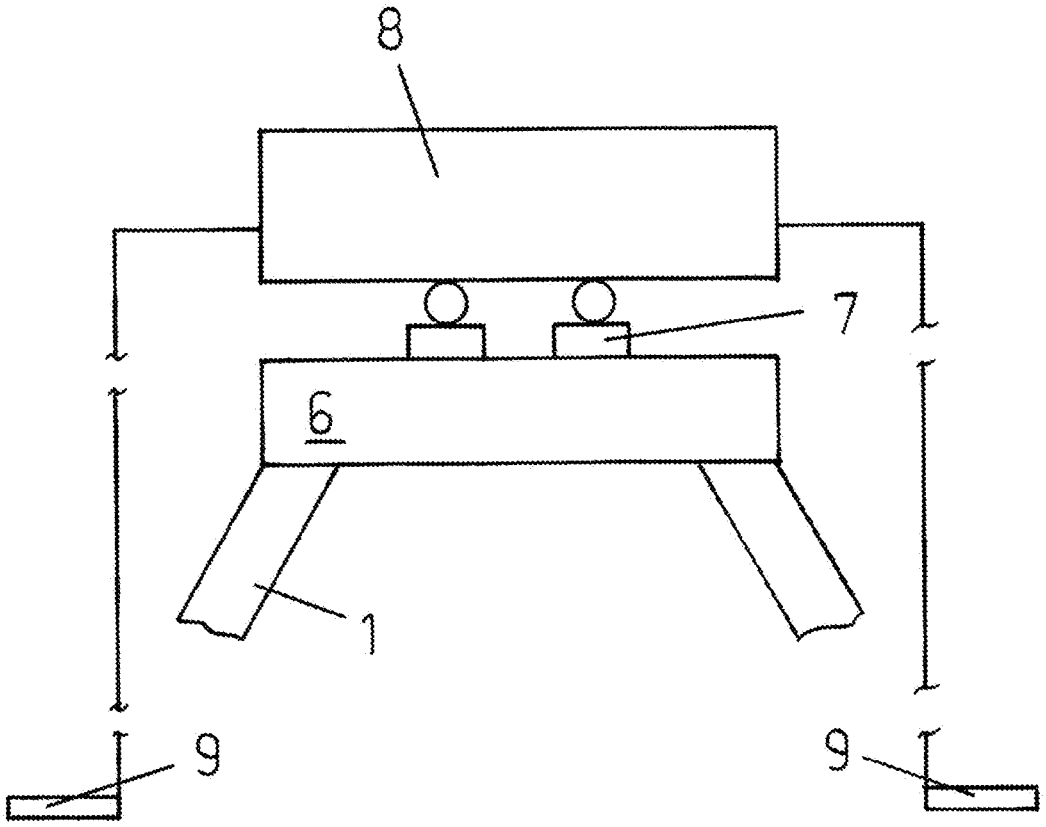
FIG. 2 shows a device for training abductors and/or adductors of the hip joint for the trunk musculature, in front view.
Figure 3:
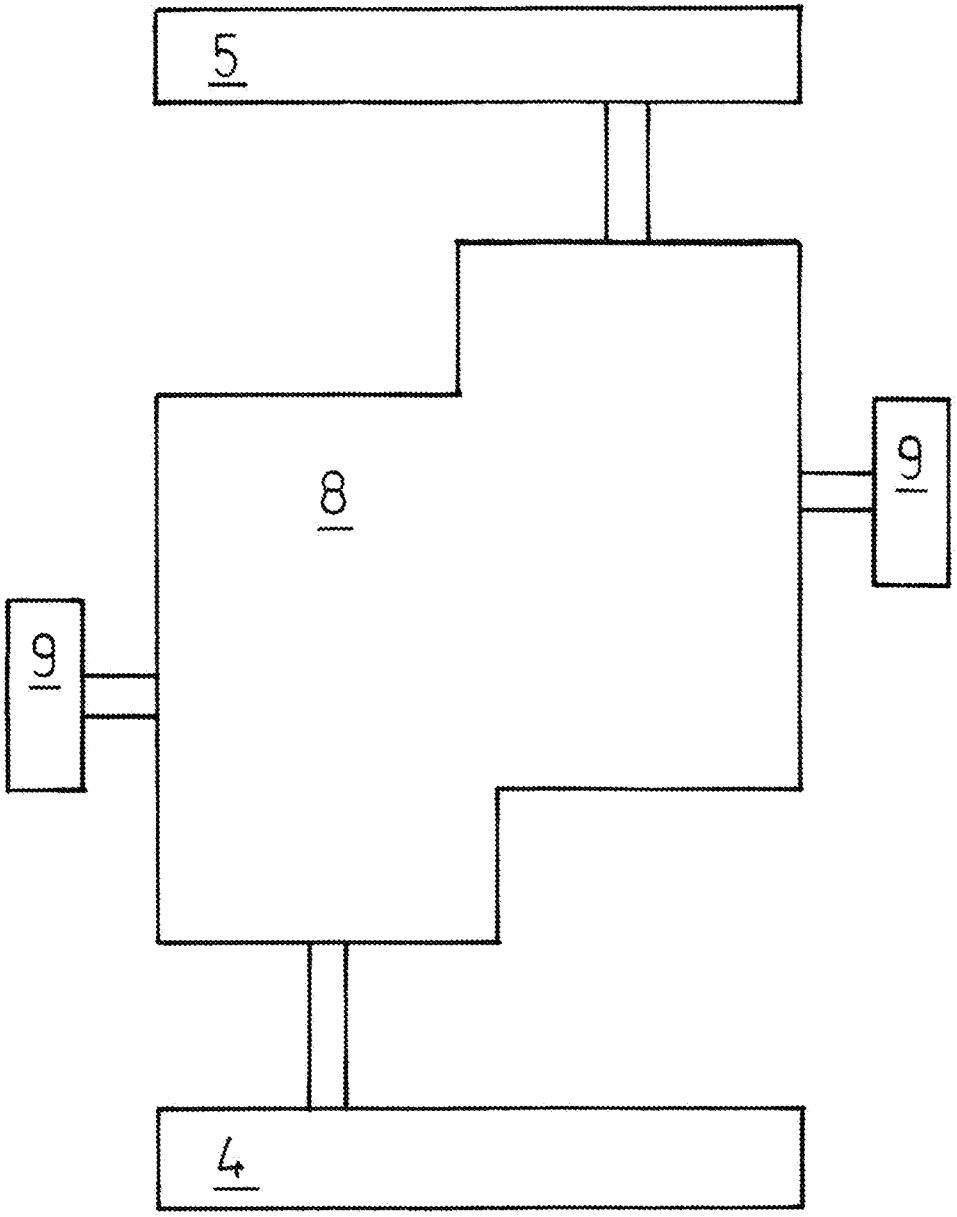
FIG. 3 shows a device for training abductors and/or adductors of the hip joint in top view.

In the drawings:

FIG. 1 shows a device for training abductors and/or adductors of the hip joint in a diagrammatic side view, FIG. 2 shows a device for training abductors and/or adductors of the hip joint for the trunk musculature, in a diagrammatic front view, FIG. 3 shows a device for training abductors and/or adductors of the hip joint in a diagrammatic top view.

The frame 1 is a rack with upright elements on a base plate and at least one lockable pivot 6 for the guiding component 7 of the seating 3. By means of at least one mechanism, the angle of the guiding component 7 with the first rest 2 fixed to it and the guided, movable seating 3 can be adjusted with respect to the footprint into various positions by inclining it and it can be locked in various positions. This is carried out by means of at least one locking mechanism, a ratchet mechanism or a gear wheel. In this regard, a self-locking worm gear or a locking mechanism with a catch may be used. The first rest 2 is disposed on the guiding component 7 of the seating 3 and at an angle thereto, for at least lateral placement of the knee 10 of a leg with the user's hip in the extended hip position or in a flexed position. The angle between the first rest 2 and the guiding component 7 may, for example, be a right angle, or it may be adjustable and lockable with respect to the guiding component 7. Furthermore, the first rest 2 may have a support for the knee 10, at least a lower leg region or the knee 10 and at least a lower leg region, disposed at an angle.

The seating 3 essentially consist of a seat 8, the second rest 4 and the third rest 5 for lateral placement of at least the upper region of the pelvis and/or at least a region of the upper body. Furthermore, footrests 9 may be provided for the foot of the respective other leg. The latter is the leg with the knee which is not placed on the first rest 2. Here, the seat 8 is advantageously the component which is guided with respect to the guiding component 7 of the seating 3 which can be moved therewith. The second rest 4 and/or the third rest 5 can be adjusted into and locked in its position or their positions in order to provide lateral fixing with respect to the seat 8. In this regard, at least one of these rests is displaceable in a guided manner and lockable. In this manner, the device can easily be adjusted as a function of the size of the user. The respective other rests 4, 5 can thus also be configured such that the lateral upper body can be positioned thereon right up to under the arm. In addition, a support 11 for the arm may be attached to these rests 4, 5.

The second rest 4 and at least one region of the seat 8 are advantageously configured and disposed in a manner such that, to train the abductors or the adductors of the hip joint, the thigh and thus the seat 8 can be moved with the hip in the extended position.

The seating 3 is connected to the frame 1 via at least the one pivot 6 and can be locked in various positions, so that the seating 3 can be tilted with respect to the footprint. For this purpose, the seat 8 with the second rest 4, the third rest 5 and any footrests 9 which are present may be formed by a straight guide formed by two mutually parallel guiding elements and at least two guided elements coupled therewith. The guides are slide or roller guides.

In this manner, abductors and adductors of the hip joint can be trained.

Figure 4:
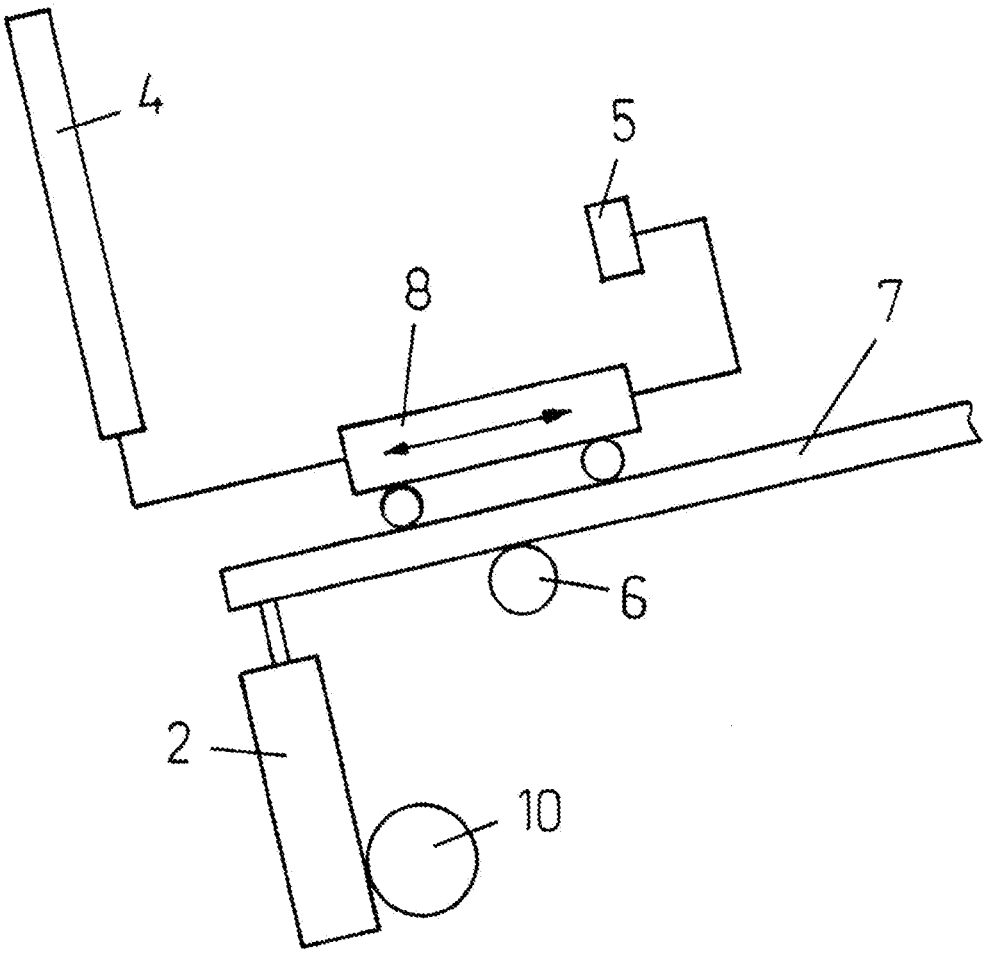
FIG. 4 shows a device set up for training the abductors.

FIG. 4 shows a diagrammatic representation of a device set up for training the abductors.

When training the abductors of the hip joint, the first rest 2 is used to push the knee 10 out, whereupon the seat 8 is moved away from this first rest 2. This is assisted by the guiding component 7 of the guide which is upwardly inclined with respect to the footprint, so that when pushing out, the user's body has to be moved in an inclined manner and upwardly.

Figure 5:
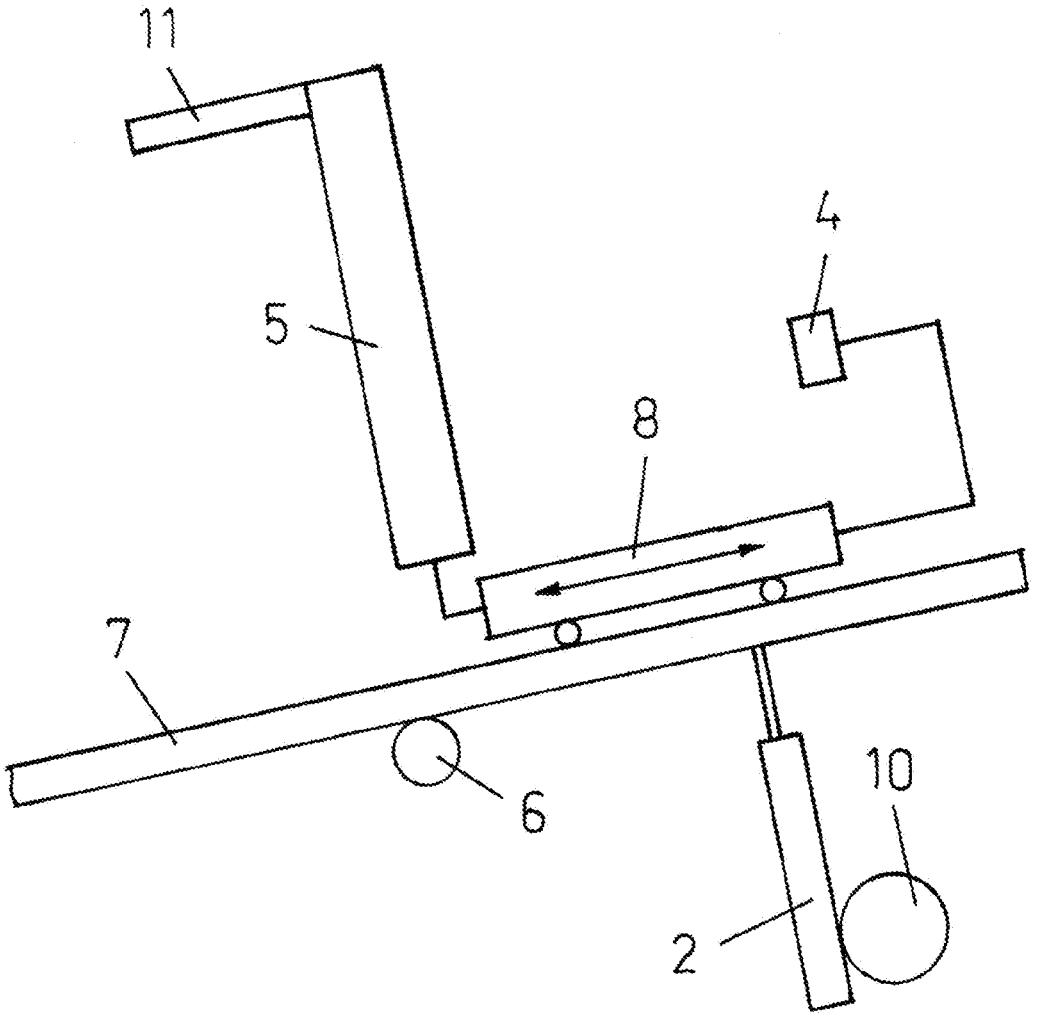
FIG. 5 shows a device set up for training the adductors.

FIG. 5 shows a diagrammatic representation of a device set up for training the adductors.

When training the adductors of the hip joint, the first rest 2 is used to pull the knee 10 in the direction of the starting position for the leg. This is assisted by the guiding component 7 of the guide which is downwardly inclined with respect to the footprint, so that when pulling in, the user's body has to be moved in an inclined manner and upwardly.

LIST OF REFERENCE NUMERALS

1 frame
2 first rest
3 seating
4 second rest
5 third rest
6 pivot
7 guiding component
8 seat
9 footrest
10 knee
11 support

The invention claimed is:

1. A device for training abductors and/or adductors of a hip joint, having a frame and guided, movable seating connected to the frame, wherein a guiding component of the seating which is pivotally connected to the frame and which can be locked in various positions is provided with a first rest configured for at least lateral placement of a knee, at least a lower leg region and/or at least a thigh region of one leg, and the guiding component of the seating is provided with a seat having a second rest and a third rest configured for lateral placement of at least an upper region of a pelvis and/or at least a region of an upper body, wherein the second rest and/or the third rest can be adjusted into the seat and locked in its position or their positions in order to provide lateral fixing.

2. The device according to claim 1, wherein the first rest is configured for pushing out the knee, at least the lower leg region and/or at least the thigh region, so that the abductors of the hip joint can be trained.

3. The device according to claim 1, wherein the first rest is configured for pulling in the knee, at least the lower leg region and/or at least the thigh region, so that the adductors of the hip joint can be trained.

4. The device according to claim 1, wherein the first rest can be displaced in a manner which is guided and can be locked in various positions with respect to the guiding component of the seating.

5. The device according to claim 1, wherein the first rest has a support which is disposed at an angle for the knee, at least a lower leg region or the knee and at least a lower leg region.

6. The device according to claim 1, wherein a support configured for at least a lower arm is connected to the second rest and/or the third rest.

7. The device according to claim 1, wherein a height of the second rest and/or its distance from the third rest can be adjusted with respect to the seating and it can be locked in various positions.

8. The device according to claim 1, wherein a height of the third rest and/or its distance from the second rest can be adjusted with respect to the seating and it can be locked in various positions.

9. The device according to claim 1, wherein the second rest and at least a region of the seat are disposed in a manner such that a thigh can be moved in an extended or flexed hip position in order to train the abductors or the adductors of the hip joint.

10. The device according to claim 1, wherein the guiding component of the seating is connected to the frame via at least one pivot or is a component of the frame, and in that the guiding component can be locked in various positions.

11. The device according to claim 1, wherein the guiding component of the seating includes the seat, and the second rest and the third rest are comprised of a straight guide.

12. The device according to claim 1, wherein the seating is provided with footrests for a foot of a respective other leg.

* * * * *